United States Patent [19]

Ringgenberg et al.

[11] Patent Number: 4,667,743

[45] Date of Patent: May 26, 1987

[54] LOW PRESSURE RESPONSIVE TESTER VALVE WITH RATCHET

[75] Inventors: Paul D. Ringgenberg; Harold K. Beck, both of Duncan, Okla.

[73] Assignee: Halliburton Company, Duncan, Okla.

[21] Appl. No.: 808,902

[22] Filed: Dec. 12, 1985

[51] Int. Cl.[4] ..... E21B 34/00

[52] U.S. Cl. ..... 166/321; 166/240; 166/324

[58] Field of Search ..... 166/162, 169, 336, 373, 166/374, 386, 250, 264, 320, 321, 323, 324, 240

[56] References Cited

U.S. PATENT DOCUMENTS

| | | | |
|---|---|---|---|
| 3,051,240 | 8/1962 | Fisher, Jr. | 166/331 X |
| 3,897,825 | 8/1975 | Tausch | 166/321 |
| 3,930,540 | 1/1976 | Holder et al. | 166/374 |
| 4,113,012 | 9/1978 | Evans et al. | 166/264 |
| 4,324,293 | 4/1982 | Hashbek | 166/264 X |
| 4,355,685 | 10/1982 | Beck | 166/240 |
| 4,422,506 | 12/1983 | Beck | 166/324 |
| 4,429,748 | 2/1984 | Beck | 166/324 |
| 4,489,786 | 12/1984 | Beck | 166/374 |
| 4,498,536 | 2/1985 | Ross et al. | 166/250 |
| 4,515,219 | 5/1985 | Beck | 166/374 |
| 4,537,258 | 8/1985 | Beck | 166/374 |

*Primary Examiner*—Stephen J. Novosad
*Assistant Examiner*—William P. Neuder
*Attorney, Agent, or Firm*—Joseph A. Walkowski

[57] ABSTRACT

An annulus pressure responsive tester valve includes a tool housing having a flow passage disposed therethrough. A ball valve is disposed in the flow passage and rotatable between closed and open positions. An actuating mandrel is operably connected to the ball valve. An annular power piston is disposed within the housing and reciprocates relative to the housing in response to changes in well annulus pressure. A lug and slot ratchet assembly operably connects the ball valve with the power piston for moving the ball valve between its closed and open positions in response to movement of the power piston within the housing.

16 Claims, 10 Drawing Figures

LOW PRESSURE RESPONSIVE TESTER VALVE WITH RATCHET

BACKGROUND OF THE INVENTION

1. Field of the Invention

The present invention relates to annulus pressure responsive downhole tools. Particularly, the present invention provides a low pressure responsive tester valve with a ratchet means operably connecting a power piston to the tester valve.

2. Description of the Prior Art

It is well known in the art that downhole tools such as testing valves, circulating valves and samplers can be operated by varying the pressure of fluid in a well annulus and applying that pressure to a differential pressure piston within the tool.

The assignee of the present invention has recently developed an annulus pressure responsive tool which operates in response to a relatively low annulus pressure increase as shown in U.S. Pat. Nos. 4,422,506 and 4,429,748, both to Beck and assigned to the assignee of the present invention.

These low pressure responsive tools shown in U.S. Pat. Nos. 4,422,506 and 4,429,748 have a power piston which is exposed to well annulus pressure from above, and which has its lower surface exposed to pressurized nitrogen gas in a nitrogen chamber located therebelow. Located below the nitrogen chamber is a metering chamber or equalizing chamber which is filled with oil. A floating piston separates the gas in the gas chamber from the oil in the metering chamber. Disposed in the metering chamber is a metering cartridge which provides a resistance to flow of oil therethrough. The lower end of the metering chamber below the metering cartridge is communicated with well annulus pressure, and a second floating piston separates the oil in the metering chamber from well fluid which enters the lower end of the metering chamber. An increase in well annulus pressure is immediately communicated to the upper surface of the power piston, but is delayed for a significant period of time in being fully communicated to the lower side of the power piston, so that a rapid increase in well annulus pressure will cause a downward pressure differential across the power piston to move the power piston and actuate the tool.

A number of modifications of the basic low pressure responsive tool have been developed by the assignee of the present invention as illustrated in U.S. Pat. No. 4,537,258 to Beck.

One particular feature of such tools to which many of the alternative designs developed by the assignee of the present invention have been directed is the provision of a means for controlling the position of the tester valve during changes in well annulus pressure. That is, while the normal operation of the tool provides for opening and closing of the ball valve in response to reciprocating motion of the power piston, it is sometimes desired to be able to maintain the ball valve in either a closed or an open position during changes in well annulus pressure. There are many reasons for this. For example, it may be desired to run the tool into the well with the ball valve in an open position. Also, it may be desired to pressure test the well annulus after the testing string is in position, without opening the ball valve.

Numerous approaches have been utilized to control the movement of the valve.

Often, an actuating mandrel associated with the valve is initially shear pinned in place to hold the valve closed while running into a well, as shown for example in FIG. 2b of U.S. Pat. No. 4,422,506.

U.S. Pat. No. 4,429,748 to Beck discloses in FIG. 2c thereof a resilient ring assembly 206 to positively control the full opening and closing of the ball valve such that the ball valve is prevented from only partially opening or closing.

U.S. Pat. No. 4,537,258 to Beck discloses several embodiments of such tools. The embodiment disclosed in FIGS. 2A–2E and FIG. 3 thereof utilizes a lug and slot arrangement disposed between the power piston and the housing for controlling movement of the power piston relative to the housing. The embodiment disclosed in FIGS. 5A–5G thereof uses a spring-loaded pin and detent arrangement 600 for locking the actuating mandrel in a position corresponding to an open position of the ball valve.

U.S. Pat. No. 4,355,685 to Beck and assigned to the assignee of the present invention shows a circulating valve having an annulus pressure responsive operating means similar to that of the tools just discussed, and including a lug and slot arrangement disposed between the power piston and the housing as seen in FIG. 1C and FIG. 4 thereof for controlling the position of the power piston relative to the housing.

Another device recently developed by the assignee of the present invention is a multi-mode testing tool shown in U.S. patent application Ser. No. 596,321, filed Apr. 3, 1984, of Ringgenberg. It is noted that application Ser. No. 596,321 itself is not prior art to the present invention; that application is being referred to only as a convenient means for describing one embodiment of the tool shown therein which is a part of the prior art. Application Ser. No. 596,321 shows several embodiments of a ratchet means for operably connecting an actuating mandrel to a power piston, but only the embodiment shown in FIG. 10 thereof is a part of the prior art. The ratchet means disclosed in FIG. 10 of the Ringgenberg application is similar in some respects to the ratchet means utilized in the tester valve of the present invention.

SUMMARY OF THE INVENTION

The present invention provides a low pressure responsive flow tester valve having a lug and slot ratchet means operably connecting the ball valve of the tool with the power piston.

This ratchet means provides a much improved structure for controlling the movement of the ball valve in response to movement of the power piston, and provides numerous operating advantages as compared to the other low pressure responsive tester valves discussed above.

The ratchet means utilized in the present invention includes a plurality of normal positions wherein an increase in well annulus pressure above hydrostatic pressure will open the ball valve, and a subsequent decrease in well annulus pressure will close the ball valve.

The ratchet means also includes an open position for allowing the tester valve to be run into the well with the ball valve in its open position.

The ratchet means further includes a closed position for allowing the well annulus to be pressure-tested without opening the ball valve after the tool is in place within a well.

The arrangement of the ratchet means allows the ball valve to be left either open or closed with no annulus pressure applied. It allows the tester valve to be run into and/or pulled out of a well with the ball valve in the open position. Additionally, this tool does not require that well annulus pressure be applied or released slowly in order to control the position of the ball valve, but instead the ball valve can be selectively maintained in either its open or closed position regardless of how quickly well annulus pressure is changed.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 2 shows the preferred embodiment of the ratchet which provides a plurality of normal operating positions, an open position which allows the tool to be run into the well with the ball valve in an open position, and a closed position which allows the well annulus to be pressure-tested without opening the ball valve.

DETAILED DESCRIPTION OF THE PREFERRED EMBODIMENTS

Figure 1A:
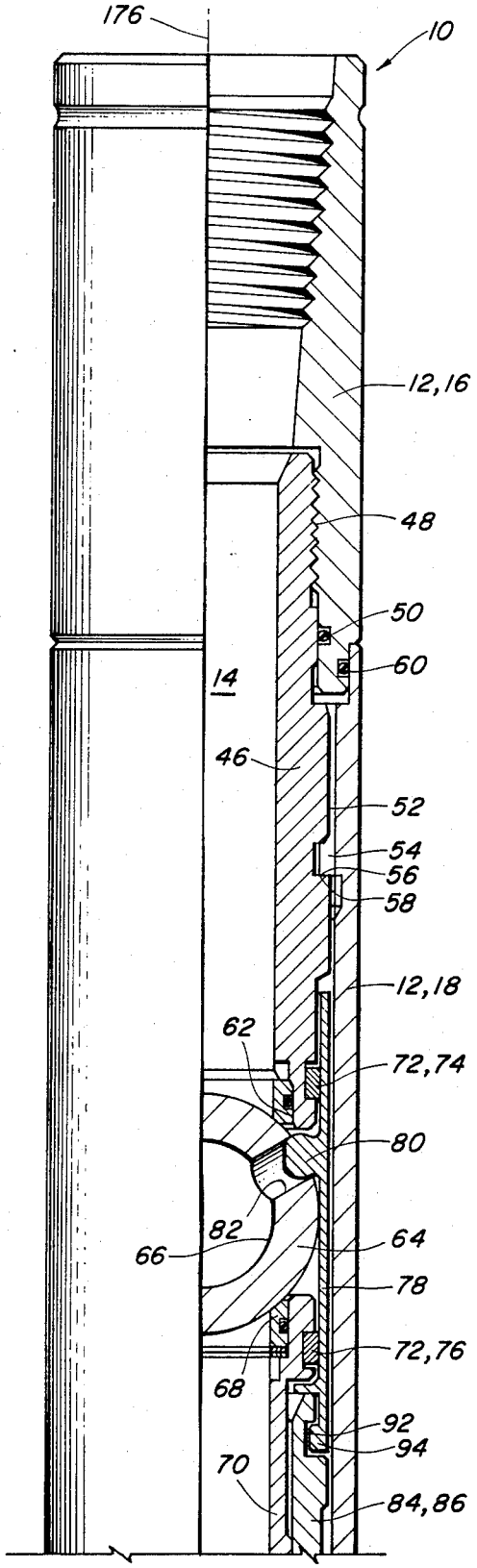
FIGS. 1A–1F comprise an elevation right side only sectioned view of the tester valve of the present invention with the ball valve thereof in a closed position.

During the course of drilling an oil well, the bore hole is filled with a fluid known as drilling fluid or drilling mud. One of the purposes of this drilling fluid is to contain any formation fluid which may be found in formations intersected by the bore hole. To contain these formation fluids, the drilling mud is weighted with various additives so that the hydrostatic pressure of the mud at the formation depth is sufficient to maintain the formation fluid within the formation without allowing it to escape into the bore hole.

When it is desired to test the production capabilities of a formation, a testing string is lowered into the bore hole to the formation depth and the formation fluid is allowed to flow into the string in a controlled testing program. Lower pressure may be maintained in the interior of the testing string relative to that in the bore hole as it is lowered into the bore hole. This is usually done by keeping a valve in the closed position near the lower end of the testing string. When the testing depth is reached, a packer is set to seal the bore hole thus closing in the formation from the hydrostatic pressure of the drilling fluid in the well annulus between the bore hole wall and the testing string.

The valve at the lower end of the testing string, which is generally referred to as a tester valve, is then opened and the formation fluid, free from the restraining pressure of the drilling fluid, can flow into the interior of the testing string.

The testing string will include a number of tools, many of which may be constructed to be operated in response to changes in pressure within the well annulus.

A detailed description of the general makeup of such a testing string as utilized in an offshore environment, and indicating the location of a tester valve in such a string, is shown, for example, in U.S. Pat. No. 4,537,258 to Beck with regard to FIG. 1 thereof, the details of which are incorporated herein by reference.

Referring now to FIGS. 1A–1F of the present application, the tester valve apparatus of the present invention is shown and generally designated by the numeral 10. The tester valve 10 includes a housing 12 having a central flow passage 14 disposed longitudinally therethrough.

The housing 12 includes an upper adapter 16, a valve housing section 18, a connector nipple 20, a power housing section 22, an upper filler nipple 24, a nitrogen chamber housing section 26 including inner and outer tubular members 28 and 30, a lower extension mandrel 32 connected to inner tubular member 28, a lower filler nipple 34, an equalizing chamber housing section 36 including inner and outer tubular members 38 and 40, a metering cartridge 42 connecting lower extension mandrel 32 and inner member 38, and a lower adapter 44.

Referring to FIG. 1A, an upper seat holder 46 is threadedly connected to upper adapter 16 at threaded connection 48 with a seal being provided therebetween by O-ring 50.

Upper seat holder 46 has a plurality of radially outward extending splines 52 which mesh with a plurality of radially inward extending splines 54 of valve housing section 18.

Upper seat holder 46 includes an annular upward facing shoulder 56 which engages lower ends 58 of the splines 54 of valve housing section 18 to thereby hold valve housing section 18 in place with the lower end of upper adapter 16 received in the upper end of valve housing section 18 with a seal being provided therebetween by O-ring 60.

An annular upper valve seat 62 is received in upper seat holder 46, and a spherical ball valve member 64 engages upper seat 62. Ball valve member 64 has a bore 66 disposed therethrough. In FIG. 1A, the ball valve member 64 is shown in its closed position so that the bore 66 of ball valve 64 is isolated from the central flow passage 14 of the tester valve 10. As will further be described below, when the ball valve 64 is rotated to its open position, the bore 66 thereof is aligned with the longitudinal flow passage 14 of tester valve 10.

The ball valve 64 is held between the upper seat 62 and a lower annular seat 68. Lower annular seat 68 is received in a lower seat holder mandrel 70.

Lower seat holder mandrel 70 is held in place relative to upper seat holder 46 by a plurality of C-clamps such as the C-clamp 72 which has upper and lower ends 74 and 76 shown in FIG. 1A.

An actuating arm 78 has an actuating lug 80 disposed thereon which engages an eccentric bore 82 disposed through the side of ball valve member 64 so that the ball valve member 64 may be rotated to an open position upon downward movement of actuating arm 78 relative to the housing 12.

Actually, there are two such actuating arms 78 with lugs 80 engaging two eccentric bores such as 82 in a manner such as that illustrated and described in detail in U.S. Pat. No. 3,856,085 to Holden et al., and assigned to the assignee of the present invention.

A connector assembly 84 includes an upper connector piece 86 and a lower connector piece 88 threadedly connected together at threaded connection 90.

Upper piece 86 has a radially outer annular groove 92 disposed therein which engages a radially inwardly extending shoulder 94 of actuating arm 78 so that actuating arm 78 reciprocates with connector assembly 84 within the housing 12.

The lower seat holder mandrel 70 has an outer surface 96 closely received within an inner cylindrical bore 98 of upper piece 86 with a seal being provided therebetween by O-ring 100.

An actuating mandrel means 102 includes an upper actuating mandrel section 104 and a lower actuating mandrel section 106 threadedly connected together at 108 with a seal being provided therebetween by O-ring 110.

A cap 112 is threadedly connected to the upper end of upper actuating mandrel section 104 at threaded connection 114. Cap 112 is trapped between a downward facing shoulder 116 of upper piece 86 of connector assembly 84 and an upper end 118 of lower piece 88 of connector assembly 84.

Figure 1B:
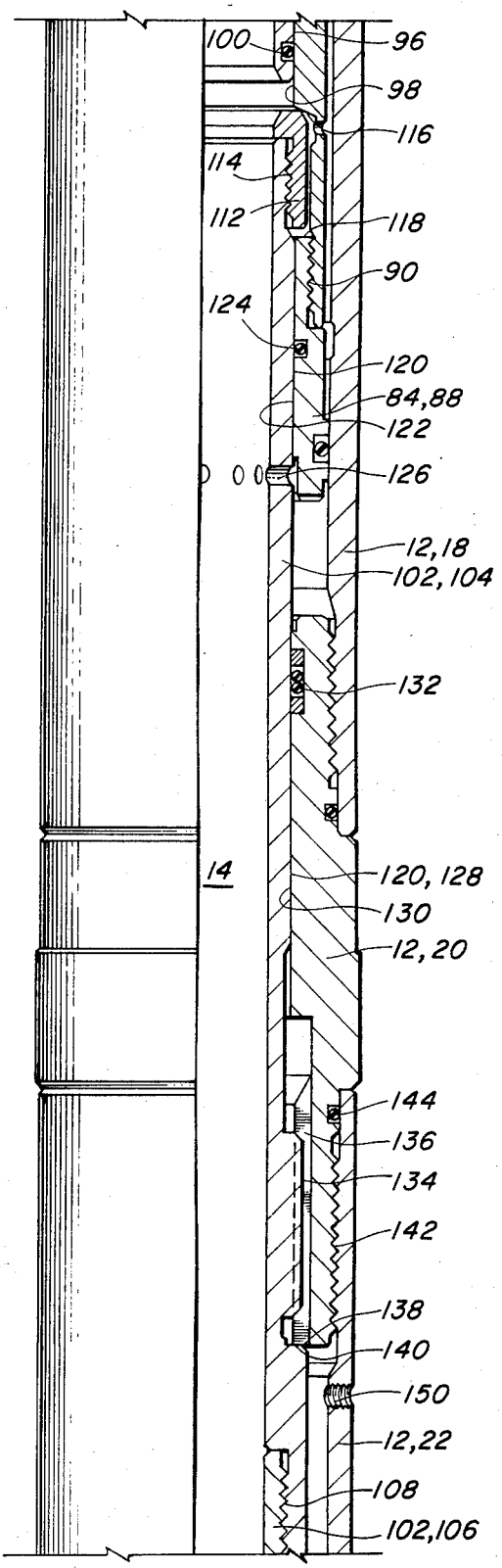

Thus, except for the slight clearance which is apparent in FIG. 1B between cap 112 and upper end 118 of lower piece 88, the connector assembly 84 will move with actuating mandrel means 102 within the housing 12. As previously mentioned, a downward movement of actuating arm 78, which would be caused by downward movement of actuating mandrel means 102, will rotate the ball valve 64 to an open position.

An outer surface 120 of upper actuating mandrel section 104 is closely received with a bore 122 of lower piece 88 with a seal being provided therebetween by O-ring 124.

A plurality of relief ports 126 are radially disposed through upper actuating mandrel section 104.

An intermediate portion 128 of outer surface 120 of upper actuating mandrel section 104 is closely received within a bore 130 of connector nipple 20 with a seal being provided therebetween by O-ring seal means 132.

Upper actuating mandrel section 104 includes a plurality of radially outward extending splines 134 which are engaged with a plurality of radially inward extending splines 136 of connector nipple 20.

Upper actuating mandrel housing section 104 includes an annular upward facing shoulder 138 which abuts lower ends 140 of splines 136 of connector nipple 20 to define an upwardmost position of actuating mandrel means 102 corresponding to the closed position of ball valve 64.

The lower end of connector nipple 20 is connected to power housing section 22 at threaded connection 142 with a seal being provided therebetween by O-ring 144.

An annular power piston 146 is slidably received within an annular chamber 148 defined between actuating mandrel means 102 and power housing section 22 of housing 12.

The power housing section 22 has first and second longitudinally spaced power ports 150 and 152 disposed therethrough for communicating a well annulus exterior of the housing 12 with an upper portion 154 of the chamber 148 above the power piston 146.

Power housing section 22 includes an annular radially inward extending flange 156 which has a downward facing shoulder 158 defined thereon.

Figure 1C:
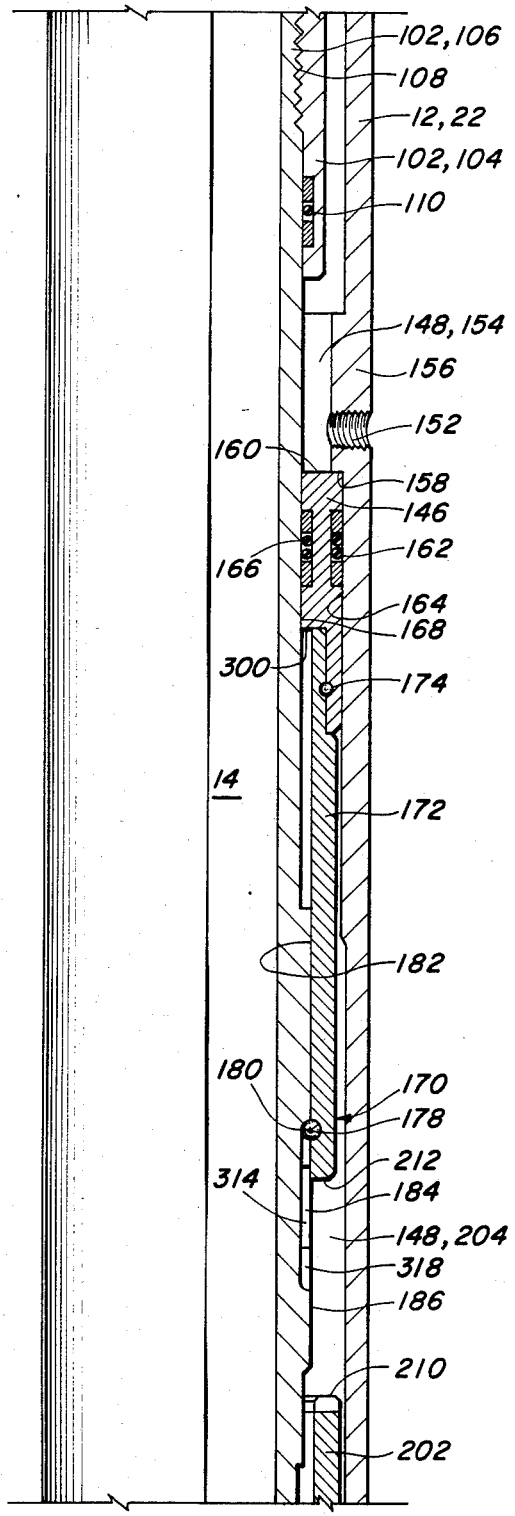

An upwardmost position of power piston 146 relative to the housing 12 is defined by abutment of an upper end 160 of power piston 146 with the downward facing shoulder 158 as seen in FIG. 1C.

Power piston 146 includes a radially outer annular seal means 162 which slidably and sealingly engages a bore 164 of power housing section 22. Power piston 146 includes an inner annular O-ring seal means 166 which slidably and sealingly engages an outer cylindrical surface 168 of lower actuating mandrel section 106. A ratchet means generally designated by the numeral 170 operably connects the actuating mandrel means 102, and thus the ball valve 64, with the power piston 146, for moving the ball valve 64 between its closed and open positions in response to movement of the power piston 146 relative to the housing 12.

Ratchet means 170 includes a ratchet sleeve 172 rotatably connected to power piston 146 by a swivel means 174. The swivel means 174 is comprised of a plurality of ball bearings received in complimentary annular semicircular cross-section grooves of the power piston 146 and ratchet sleeve 172 so that the ratchet sleeve 172 can rotated about a longitudinal central axis 176 (see FIG. 1A) of housing 12 relative to the power piston 146.

The ratchet means 170 includes a ball lug 178 which is partially received within a ball receiving cavity 180 disposed in an inner surface 182 of ratchet sleeve 172.

The ball lug 178 extends radially inward from the ratchet sleeve 172 into engagement with a ratchet slot means 184 defined in an enlarged diameter radial outer surface 186 of lower section 106 of actuating mandrel means 102.

Figure 2:
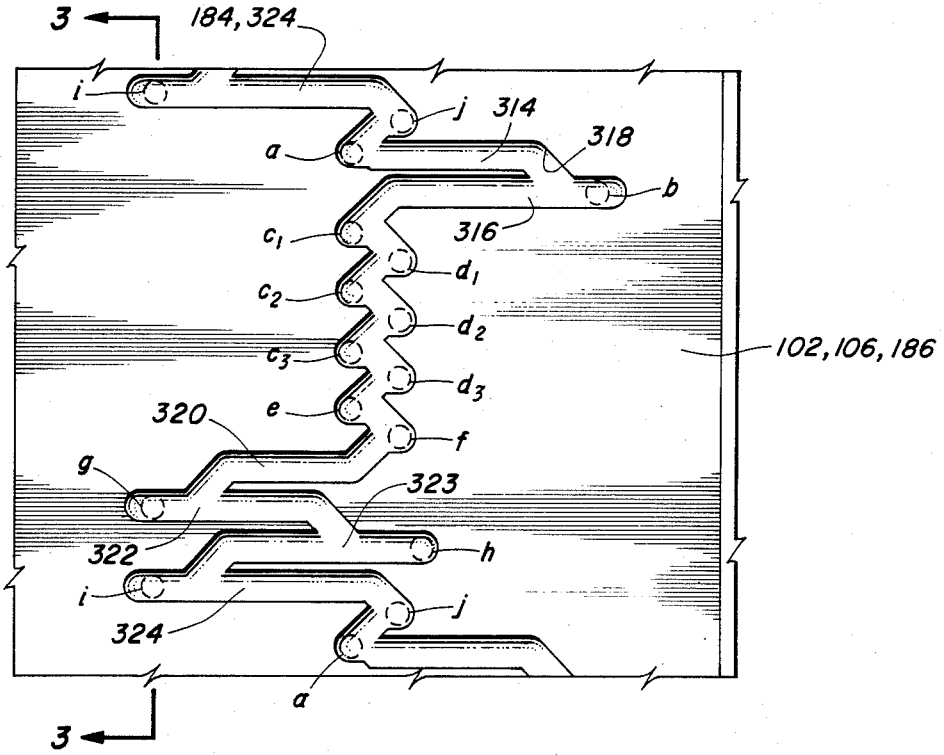
FIG. 2 is a laid-out view of a portion of the actuating mandrel having the slot of the ratchet means disposed thereon.

The details of construction of the ratchet slot means 184 are shown in FIG. 2 and described in further detail below.

A lower portion 186 of lower actuating mandrel section 106 is closely and slidably received within a bore 188 of upper filler nipple 24 and a pair of O-ring seal means 190 and 192 are provided therebetween.

A relief port 194 communicates a groove 196 disposed in the bore 188 of upper filler nipple 24 between seals 190 and 192 to prevent hydraulic lockup of the actuating mandrel means 102.

A lower end of the power housing section 22 is threadedly connected to upper filler nipple 24 at threaded connection 198 with a seal being provided therebetween by O-ring seal means 200.

A cylindrical stop sleeve 202 is concentrically received within a lower portion 204 of chamber 148 below power piston 146.

Stop sleeve 202 has a lower end 206 which rests upon an upper end 208 of upper filler nipple 24. Stop sleeve 202 has an upper end 210 arranged to abut a lower end 212 of ratchet sleeve 172 to thereby limit a downward stroke of power piston 146 when the ratchet means 170 is in a closed position. The closed position will be further described below with regard to FIG. 2, but generally the closed position is a position of the ball lug 178 within the ratchet slot 184 which permits a well annulus exterior of the housing 12 to be pressure tested without moving the ball valve 64 to an open position.

Figure 1D:
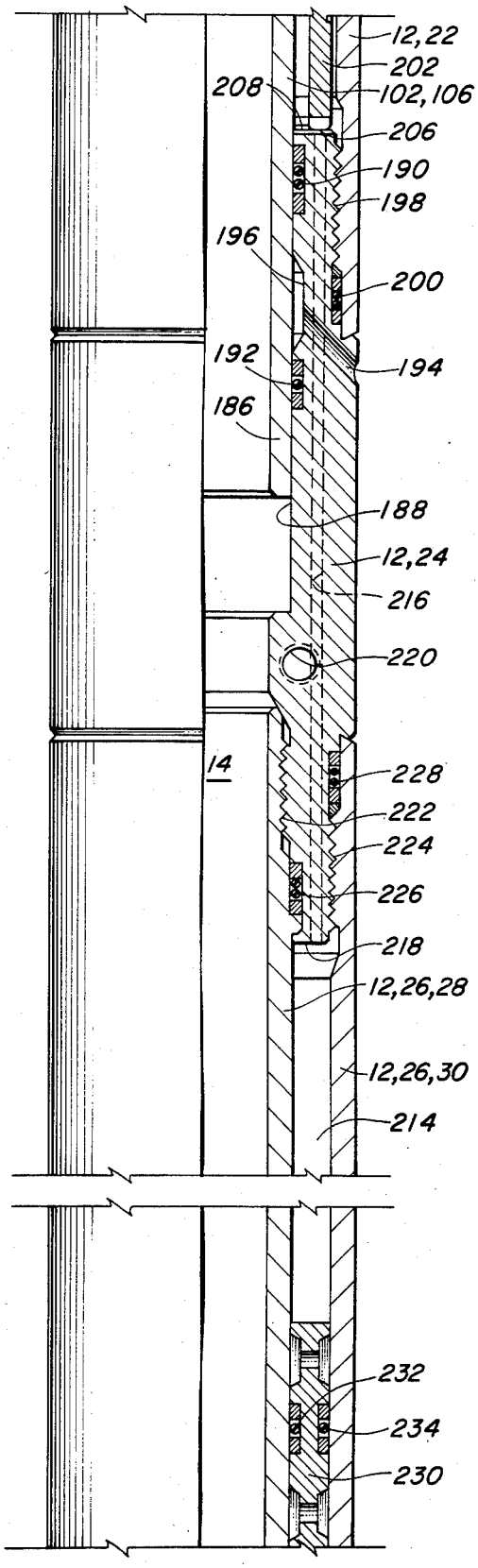
Figure 1E:
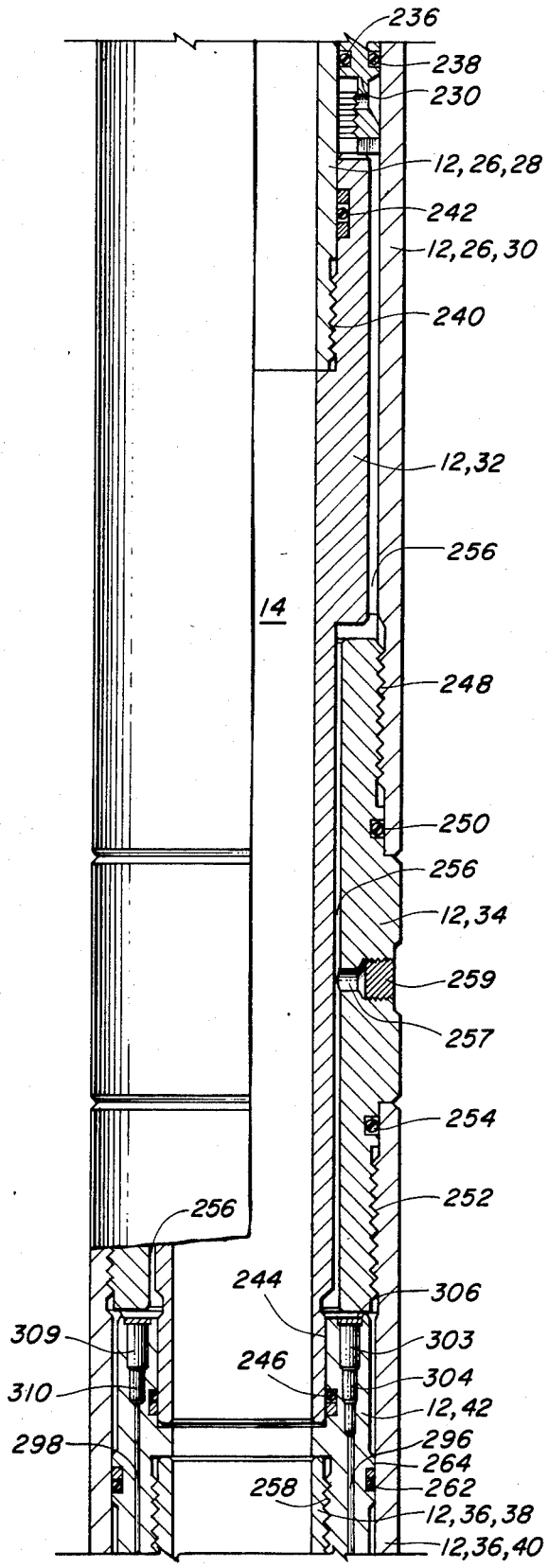
Figure 1F:
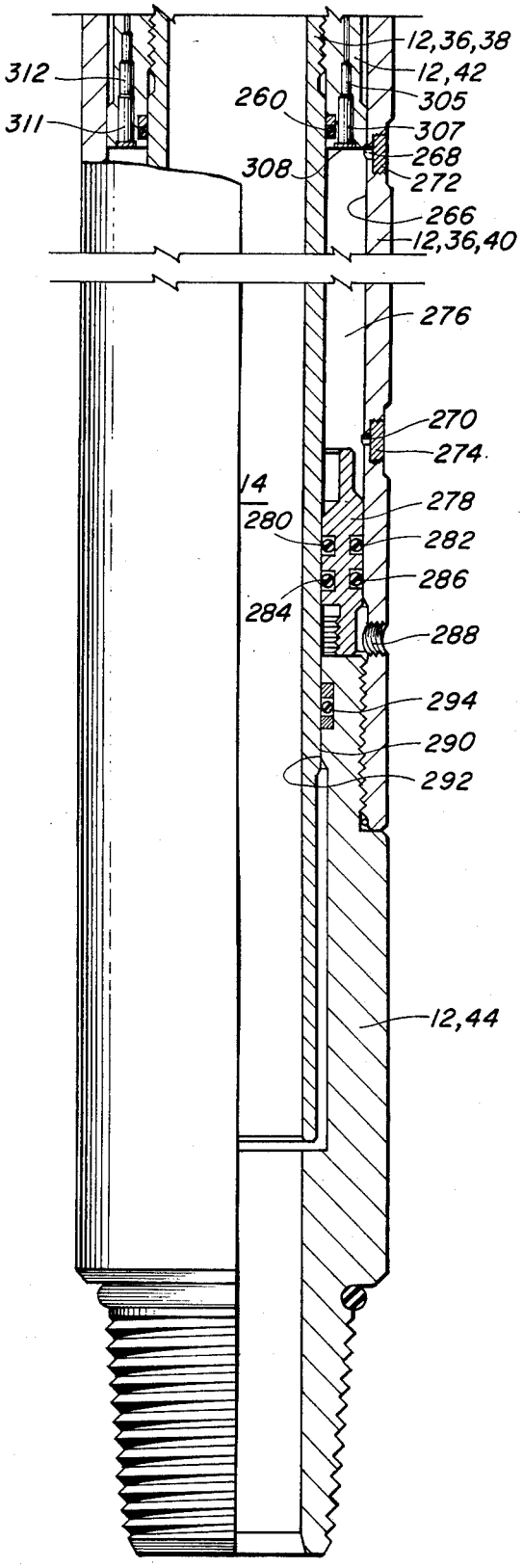

An annular nitrogen chamber 214 is defined between inner and outer tubular members 28 and 30 of nitrogen housing section 26 of housing 12 as seen in FIG. 1D.

Upper filler nipple 24 has a plurality of longitudinal ports 216 disposed therethrough connecting its upper end 208 with a lower end 218 thereof, for communicating the nitrogen chamber 214 with the lower portion 204 of annular chamber 148.

A conventional filter valve (not shown) is disposed in a trasverse bore 220 of upper filler nipple 24, which communicates with one of the longitudinal ports 216 for filling the nigtrogen chamber 214 and the lower portion 204 of chamber 148 with a high pressure nitrogen gas. Typically, the nitrogen gas will be pressurized prior to placing the tester valve 10 in a well, to a pressure in the range of 1000 to 7000 psi. The actual charge pressure for any given job will depend upon the hydrostatic pressure and the temperature present in the well at the depth of the formation. For example, a formation at a depth such that the hydrostatic well annulus pressure is 4000 psi, and at typical temperatures, would require a nitrogen gas charge of about 3000 psi.

The inner and outer tubular members 28 and 30 of nitrogen housing section 26 of housing 12 are threadedly connected to upper filler nipple 24 at threaded connections 222 and 224, respectively, with seals being provided therebetween by O-ring seal means 226 and 228, respectively.

An annular floating piston 230 is slidably received in the lower end of nitrogen chamber 214 and has annular upper inner and outer seals 232 and 234, respectively, which slidably seal against inner tubular member 28 and outer tubular member 30 of nitrogen chamber housing section 26 of housing 12.

Piston 230 also includes lower inner and outer O-ring seals 236 and 238, respectively.

The lower extension mandrel 32 is threadedly connected to the lower end of inner tubular member 28 at threaded connection 240 with a seal being provided therebetween by O-ring 242.

A lower end of lower extension mandrel 32 is closely received within a bore 244 of metering cartridge 42 with a seal being provided therebetween by O-ring 246.

Outer tubular member 30 is threadedly connected to lower filler nipple 34 at threaded connection 248 with a seal being provided therebetween by O-ring 250. The lower end of lower filler nipple 34 is threadedly connected to outer member 40 of equalizing chamber housing section 36 at threaded connection 252 with a seal being provided therebetween by O-ring 254.

An irregular annular oil flow passage 256 is defined longitudinally between floating piston 230 and metering cartridge 42, and radially between lower extension mandrel 42 on the inside and outer tubular member 30 and lower filler nipple 34 on the outside.

The inner member 38 of equalizing chamber housing section 36 of housing 12 is connected to metering cartridge 42 at threaded connection 258 with a seal being provided therebetween by O-ring 260.

An O-ring 262 seals between an outer surface 264 of metering cartridge 42 and an inner bore 266 of outer tubular member 40.

Outer tubular member 40 has first and second oil fill ports 268 and 270 disposed therethrough which are blocked by plugs 272 and 274, respectively.

An equalizing chamber 276 is defined between inner and outer tubular members 38 and 40 of equalizing chamber housing section 36.

The metering cartridge 42 has a pressurizing passage 296 and a depressurizing passage 298 disposed longitudinally therethrough, each of which communicate the irregular annular oil flow passage 256 with the equalizing chamber 276.

A second floating piston 278 is received in the lower end of equalizing chamber 276.

Piston 278 includes radially inner and outer upper seals 280 and 282, respectively, and radially inner and outer lower seals 284 and 286, respectively.

An equalizing port 288 is disposed through outer tubular member 40 to communicate the lower end of equalizing chamber 276 below piston 278 with a well annulus exterior of the housing 12.

The inner tubular member 38 has an outer cylindrical surface 290 of a lower portion thereof closely received within a bore 292 of lower adapter 44 with a seal being provided therebetween by O-ring 294.

The power ports 150 and 152 (see FIGS. 1B and 1C) and the upper portion 154 of chamber 148 above power piston 146 can generally be referred to as a first pressure conducting passage means for communicating the well annulus exterior of the housing 12 with the upper first side 160 of power piston 146.

The equalizing port 288, equalizing chamber 276, pressurizing passage 296 through metering cartridge 42, irregular annular oil flow passage 256, nitrogen chamber 214, longitudinal ports 216 and lower portion 204 of annular chamber 148 can generally be described collectively as a second pressure conducting passage means for communicating the well annulus exterior of the housing 12 with a lower second side 300 of power piston 146.

The lower filler nipple 34 has an oil fill port 257 disposed therethrough which is blocked by a plug 259.

The irregular annular oil flow passage 256, and the equalizing chamber 276 are filled with a suitable oil by means of the oil fill ports 257, 268 and 270.

The second floating piston 278 separates the oil thereabove in the equalizing chamber 276 from well fluid which enters the equalizing port 288 therebelow.

Devices located in the pressurizing passage 296 control the flow of oil upward from equalizing chamber 276 to the bottom side 300 of power piston 146.

The pressurizing passage 296 has disposed therein an upper filter 303, a pressure relief or check valve 304, a flow restrictor 305, and a lower filter 307. Upper and lower screens 306 and 308, respectively, cover the ends of pressurizing passage 296.

The flow restrictor 305 comprises a small orifice jet which impedes the flow of fluid from equalizing chamber 276 to oil flow passage 256 so as to provide a time delay in the transmission of increases in well annulus pressure to the lower side 300 of power piston 146.

Item 304 will usually be a pressure relief valve means which allows flow in an upward direction therethrough when the pressure in equalizing chamber 276 exceeds the pressure in oil flow passage 256 by a predetermined value, for example, 400 psi. Pressure relief valve 304 does not permit flow in a downward direction through the pressurizing passage 296. In some instances, a simple one-way check valve may be substituted for the pressure relief valve 304.

The depressurizing passage 298 includes upper filter 309, a flow restrictor 310, a pressure relief or check valve 312, and a lower filter 311.

Pressure relief valve 312 allows downward flow therethrough but prevents upward flow therethrough. Again, the pressure relief valve 312 will typically be set to require a 400 psi downward pressure differential to open the pressure relief valve 312.

Flow restrictor 310 impedes the flow of fluid downward through the depressurizing passage 298 and provides a time delay in transmission of decreases in well annulus pressure from the well annulus to the lower side 300 of power piston 146.

Again, in some instances, a simple one-way check valve may be substituted for the pressure relief valve 312.

The operation of the pressure relief valves 304 and 312 will be better understood from the following example. After the tester valve 10 has been set at the desired location within a well, typically a pressure increase of 1000 psi will be imposed upon the well annulus so that the pressure exterior of the housing 12 exceeds hydrostatic pressure by 1000 psi.

The 400 psi pressure relief valve 304 will allow only 600 psi of this pressure increase to be felt on the lower side 300 of power piston 146. Of course, there will be a significant time delay on the order of two minutes or more, for the entire 600 psi pressure increase to be felt on the lower side of power piston 146 as a result of the fluid flow restrictor 305.

Subsequently, when well annulus pressure is dropped back to hydrostatic pressure, the 400 psi pressure relief valve 312 will trap a pressure between the power piston 146 and the metering cartridge 42 at a level 400 psi above hydrostatic pressure.

The fluid restrictor 305 in the pressurizing passage 296 can generally be referred to as a retarding means 305 disposed in the second pressure conducting passage means for delaying communication of a sufficient portion of an increase in well annulus pressure to the lower second side 300 of power piston 146 for a sufficient time to allow a pressure differential from the upper first side 160 to the lower second side 300 of power piston 146 to move the power piston downward relative to the housing 12 in response to a rapid increase in well annulus pressure.

The power piston 146 is reciprocated within the housing 12 in response to changes in well annulus pressure in the following general manner.

A rapid increase in well annulus pressure will be immediately transmitted to the upper side 160 of power piston 146, but will be delayed in being communicated with the lower side 300 of power piston 146, so that a rapid increase in well annulus pressure will create a downward pressure differential across the power piston 146 thus urging it downward within the housing 12.

Similarly, a rapid decrease in well annulus pressure will create an upward pressure differential across power piston 146 moving the power piston 146 upward relative to the housing 12.

These reciprocating motions of the power piston 146 within the housing 12 are selectively transmitted by the ratchet means 170 to the actuating mandrel means 102 and thus to the ball valve 64 to operate the ball valve 64 in a number of ways as determined by the construction of the ratchet slot 184 disposed in the outer surface 186 of the lower actuating mandrel section 106, as is best seen in FIG. 2.

If it is desired to run the tester valve 10 into the well with the ball valve 64 thereof in a closed position, the ball lug 178 will be initially located in position a as shown in FIG. 2 which corresponds to the position illustrated in FIG. 1C.

The tester valve 10 will be assembled and placed in the position illustrated in FIGS. 1A–1F, and the nitrogen chamber 214 and lower portion 204 of chamber 148 will be filled with pressurized nitrogen gas, and the equalizing chamber 276 and oil flow passage 256 will be filled with oil as previously described.

In position a shown in FIG. 1 and FIG. 1C, the pressurized nitrogen gas from nitrogen chamber 214 will be acting upward against power piston 146 holding it in its upwardmost position abutting the shoulder 158 of power housing section 22, with the ball valve 64 in its closed position as seen in FIG. 1A.

As the tester valve 10 is slowly lowered into the well along with the other portions of the test string previously described, increases in hydrostatic pressure will be balanced across the power piston 146 so that it generally will remain in the position seen in FIG. 1C. As will be understood by those skilled in the art, the opening of the fluid restrictor 305 in pressurizing passage means 296 of metering cartridge 42 is sized such that relatively slow pressure increases such as the increase in hydrostatic pressure as the tester valve 10 is slowly lowered into the well can be transmitted therethrough sufficiently quickly to prevent the creation of a downward pressure differential across power piston 146.

After the test string is lowered to its desired location within the well, a packer (not shown) located below the tester valve 10 will be set to seal the well annulus exterior of the housing 12 below the tester valve 10.

It is sometimes desired to conduct a pressure test on /the well annulus to test the seal of the packer within the well bore without opening the ball valve 64. Also, it may be desired to leave ball valve 64 closed during some other fluctuation in annulus pressure, such as for example during a circulating operation or when operating some other annulus pressure responsive tool in the testing string.

The ratchet slot 184 provides a means for accomplishing these operations by the presence of the elongated slot portions 314 and 316.

When well annulus pressure is increased to test the seal on the packer, the ball lug 178 will move from position a to position b near the lower end of slot portion 316. As is apparent in FIG. 2, the ball lug when in position b stops short of the lowermost end of slot portion 316 and the ball lug 178 does not cause the actuating mandrel means 102 to move as the ball lug 178 moves from position a to position b.

The downward stroke of the power piston 146 is limited by engagement of the lower end 212 of ratchet sleeve 172 with the upper end 210 of stop sleeve 202 thus defining the lowermost position b of ball lug 178 relative to the actuating mandrel means 102.

As the ball lug 178 moves downward from position a through slot portion 314, it will engage an inclined surface 318 causing ratchet sleeve 172 to rotate clockwise as viewed from above relative to the actuating mandrel means 102.

After the pressure test of the well annulus is completed, and well annulus pressure is allowed to return to hydrostatic pressure, the ball lug 178 will move upward from position b through slot portion 316 to position $c_1$ as seen in FIG. 2.

The position a of ball lug 178 can generally be described as a closed position wherein the ball valve 64 is maintained in its closed position even if the pressure in the well annulus exceeds hydrostatic pressure, so that the well annulus can be pressure tested without opening the ball valve 64.

The position $c_1$ is the first of three normal positions designated in FIG. 2 as $c_1$, $c_2$ and $c_3$. In each of these normal positions, an increase in well annulus pressure will cause the power piston to move downward moving the ball lug to one of the positions $d_1$, $d_2$ or $d_3$, thus pulling the actuating mandrel means 102 downward and rotating the ball valve 64 to an open position wherein its bore 66 is aligned with the longitudinal flow passage 14 of tester valve 10.

For example, when the ball lug 78 is in the first normal position $c_1$, a subsequent increase in well annulus pressure will force the power piston 146 downward thus moving the ratchet sleeve 172 and ball lug 178 downward so that ball lug 178 moves to position $d_1$ relative to ratchet slot 184, thus pulling the actuating mandrel means 102 downward relative to housing 12 and rotating the ball valve 64 to an open position. Upon releasing the annulus pressure and allowing annulus pressure to return to hydrostatic pressure or lower, such as in the instance where the tester valve 10 is removed from the bore hole, pressure trapped below the power piston 146 will force the power piston 146 back upward to the position shown in FIG. 1C, and the ball lug 178 will move upward to position $c_2$ thus pulling the actuating mandrel means 102 back upward to the position seen in FIGS. 1A–1F and rotating the ball valve 64 back to its closed position of FIG. 1A.

After the third such normal reciprocating cycle, the ball lug 178 will return from position $d_3$ to position e wherein the ball valve 64 is held in a closed position. Upon the next increase in annulus pressure, however, the ball lug 178 will move from position e to position f thus pulling the actuating mandrel means 102 downward and rotating the ball valve 64 to an open position. Upon releasing annulus pressure, however, the ball lug 178 will move from position f back through an elongated portion 320 of slot 184 to position g short of the uppermost end of an elongated portion 322 of ratchet slot 184.

As the ball lug 178 moves upward from position f to position g relative to the actuating mandrel means 102, it does not pull the actuating mandrel means 102 upward, and thus the ball valve 64 is allowed to remain in its open position even though well annulus pressure has been returned to hydrostatic pressure or lower, such as when the tester valve 10 is being removed from the borehole.

A subsequent cycle in well annulus pressure will cause the ball lug to move from position g through slot portion 323 to position h upon an increase in well annulus pressure, and then to position i upon a subsequent decrease in well annulus pressure, all without further affecting the position of ball valve 64. That is, the ball valve 64 will remain in its open position as the ball lug 178 moves from position g to position h to position i.

The next increase in well annulus pressure will cause the ball lug 178 to move through slot portion 324 to position j, wherein the ball valve 64 is still open, and upon releasing the well annulus pressure, the ball lug 178 will move upward to another position a, which is equivalent to the original starting position previously described, wherein the ball valve 64 is returned to its closed position.

There are actually diametrically opposed ball lugs 178 associated with the ratchet sleeve 170 on opposite sides of the actuating mandrel.

The ratchet slot 184 runs through a complete cycle from one position a to a second position a as the ratchet sleeve 172 rotates through 180° about the actuating mandrel means 102.

Figure 3:
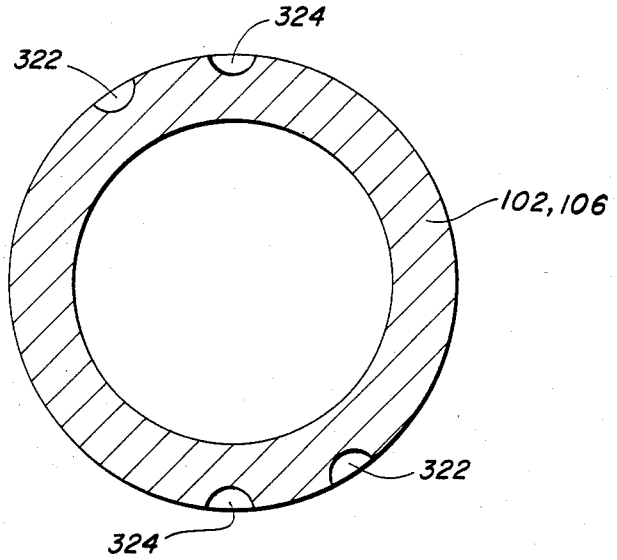
FIG. 3 is a section view taken along line 3—3 of FIG. 2.

This can be best appreciated by viewing FIG. 3, which is a horizontal section view taken along line 3—3 of FIG. 2, where it can be readily seen that there are two elongated slot portions 322 and two elongated slot portions 324 on diametrically opposite sides of the actuating mandrel means 102.

The elongated slot portions 320 and 322 traversed as the ball lug moves from position f to position g, then to position h can be described as a means for selectively maintaining the ball valve 64 in its open position during one reciprocating cycle, that is, one downward movement and one upward movement or vice versa, of the power piston 146. Similarly, the elongated slot portions 323 and 324 can be described as a means for selectively maintaining the ball valve 64 in its open position during one reciprocating cycle of power piston 146.

The elongated slot portions 314 and 316 can be described generally as a means for selectively maintaining the ball valve 64 in its closed position during one reciprocating cycle of the power piston 146.

It is noted that the elongated portions 320, 322, 323 and 324 of ratchet slot 184 allow the ball valve 64 to be selectively maintained in its open position with only hydrostatic or lower pressure surrounding tester valve 10, regardless of how quickly well annulus pressure is reduced. That is, there is no need to slowly bleed off well annulus pressure to minimize the upward pressure differential acting across power piston 146 in view of the time delay provided by fluid restrictor 310 in depressurizing passage 298.

It will also be readily apparent that the tester valve 10 can be pulled out of the well with the ball valve 64 in its open position by cycling the power piston 146 until the ball lug 178 comes to rest in position g or i wherein the ball valve 64 remains open even though there is only hydrostatic or lower pressure acting upon the power piston 146.

If it is desired to run the tester valve 10 into the well with the ball valve 64 in its open position, the power piston 146 can be cycled prior to running the tester valve 10 into the well, until the ball lug 178 is in position g or i so that the ball valve 64 is open. Then, after the tester valve 10 has been located at the desired location within the well, and the packer therebelow has been set, the power piston 146 can be reciprocated once or twice as appropriate to move the ball lug 178 to the position a to close the ball valve.

Then, the well annulus can be tested if desired, and in any event, the power piston 146 can be cycled once more to bring the ball lug 178 to the first normal position $c_1$ so that the tester valve 10 is ready to being a program of repeated flow tests on the subsurface formation being tested.

Figure 4:
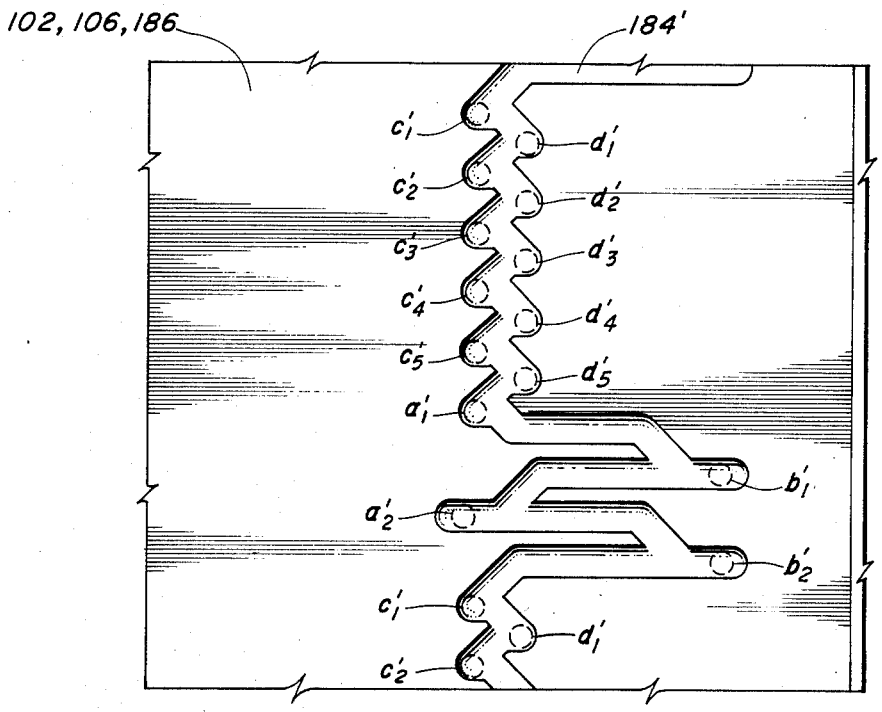
FIG. 4 is a laid-out view similar to FIG. 2 of an alternative embodiment of the ratchet means of the present invention which provides the normal and closed positions previously mentioned, but which does not provide an open position.

Alternative Embodiment of FIG. 4

FIG. 4 illustrates an alternative construction 184' for the ratchet slot which has been modified to delete the elongated slot portions 320, 322, 323 and 324 which allowed the ball valve 64 to remain in an open position as the tester valve 10 is run into the well.

With the ratchet slot 184' of FIG. 4, the ball lug 178 will normally be located in position $a_1'$ or $a_2'$ wherein the ball valve 64 is closed. Subsequent increases in well annulus pressure will move the ball lug to positions $b_1'$ or $b_2'$, thus allowing the well annulus to be pressure tested, and subsequently the ball lug 178 will return to a first normal position $c_1'$ wherein the tester valve 10 is ready to begin a program of formation flow tests.

As previously described, subsequent increases in well annulus pressure will move the ball lug 178 downward to a position such as $d_1'$ wherein the ball valve 64 is held open to allow the formation to flow upward through the tester valve 10, and a subsequent decrease in well annulus pressure back to hydrostatic pressure will cause the ball lug to return to the next normal position such as $c_2'$ thus reclosing the ball valve 64.

Figure 5:
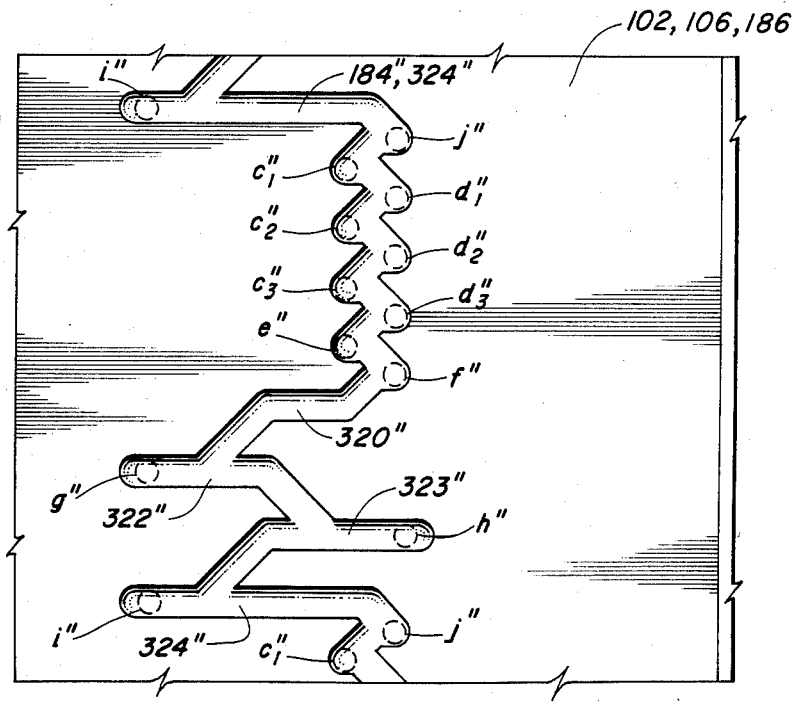
FIG. 5 is a laid-out view similar to FIG. 2 of yet another alternative embodiment of the present invention which provides normal and open positions as previously described, but which does not provide a closed position.

Alternative Embodiment of FIG. 5

FIG. 5 shows another alternative embodiment 184" for the ratchet slot 184.

The embodiment 184" has eliminated the elongated slot portions 314 and 316 of FIG. 2 so that the ratchet slot 184" does not permit the ball valve 64 to be maintained in a closed position while pressure testing the well annulus.

With the embodiment of FIG. 5, if the tester valve 10 is to be run into the well in a closed position, the ball lug 178 will initially be located in the first normal position $c_1''$. After the tester valve 10 is located at the desired position within the well and the packer therebelow is set within the well bore, the flow test program can be commenced by increasing well annulus pressure to move the ball lug 178 to the position $d_1''$ thus opening the ball valve 64 and allowing the formation to flow.

There are three normal positions $c_1''$, $c_2''$ and $c_1''$ in the ratchet slot 184" of FIG. 5.

The three normal positions $c_1''$, $c_2''$ and $c_3''$ are followed by positions e", f", g", h", i" and j" which correspond to positions e, f, g, h, i and j previously described with regard to FIG. 2.

From position j", the ball lug 178 returns to the first normal position $c_1''$.

With the ratchet slot 184" of FIG. 5, the tester valve 10 can be run into the well or pulled out of the well with the ball valve 64 in its open position by cycling the power piston 146 until the ball lug 178 is in either position g" or i" wherein the ball valve 64 is open.

With the embodiment of either FIG. 4 or 5, an advantage is provided as compared to the embodiment of FIG. 2 if the additional operating features provided by the embodiment of FIG. 2 are not needed.

For example, if a particular well does not require the locked open cycle as provided by the slots 314 and 316 of FIG. 2, then it is advantageous to eliminate those cycles and utilize the embodiment of FIG. 5 in order to shorten the overall cycling time for the tool. That is, if the locked closed cycle provided by slot portions 314 and 316 is not going to be utilized, it unnecessarily consumes considerable rig time to pressurize and depressurize the well annulus to cycle the ball lug 178 through that unused portion of the slot 184.

Thus it is seen that the apparatus of the present invention readily achieves the ends and advantages mentioned as well as those inherent therein. While certain preferred embodiments of the invention have been illustrated and described for the purposes of the present disclosure, numerous changes in the arrangement and construction of parts may be made by those skilled in the art, which changes are embodied within the scope and spirit of the present invention as defined by the appended claims.

What is claimed is:

1. An annulus pressure responsive tester valve apparatus, comprising:

a tool housing having a central flow passage extending therethrough from the top to the bottom thereof;

a power piston slidably disposed in said housing;

a first pressure conducting passage means for communicating a well annulus with a first side of said power piston;

a second pressure conducting passage means for communicating said well annulus with a second side of said power piston;

retarding means, disposed in said second pressure conducting passage means, for delaying communication of a sufficient portion of a change in well annulus pressure to said second side of said power piston for a sufficient time to allow a pressure differential between said first side and said second side of said power piston to move said power piston relative to said housing;

flow tester valve means, disposed in said housing for selectively opening and closing said central flow passage in said housing, and movable between a closed position wherein said central flow passage is closed, and an open position wherein said central flow passage is open; and lug and slot ratchet means, operably connecting said flow tester valve means with said power piston, for moving said flow tester valve means between its said closed and open positions in response to movement of said power piston relative to said housing.

2. The apparatus of claim 1, wherein:

said ratchet means is further characterized as a means for allowing said flow tester valve means to remain in at least one of its said closed and open positions during at least one reciprocating cycle of said power piston.

3. The apparatus of claim 2, wherein:

said ratchet means is further characterized as a means for allowing said flow tester valve means to remain in each of its said closed and open positions during at least one reciprocating cycle of said power piston.

4. The apparatus of claim 3, wherein:

said ratchet means is further characterized as a means for selectively maintaining said flow tester valve means in its open position as said apparatus is run into or pulled out of a well, and for selectively maintaining said flow tester valve means in its closed position to allow pressure in said well annulus to be increased without opening said flow tester valve means.

5. The apparatus of claim 1, wherein:

said ratchet means is further characterized as a means for selectively maintaining said flow tester valve means in its open position as said apparatus is run into or pulled out of a well.

6. The apparatus of claim 1, wherein :

said ratchet means is further characterized as a means for selectively maintaining said flow tester valve means in its closed position to allow pressure in said well annulus to be increased without opening said flow tester valve means.

7. The apparatus of claim 1, wherein:

said apparatus further includes a valve actuating mandrel slidably disposed in said housing and operably associated with said valve means;

said ratchet means includes a ratchet sleeve concentrically received about said valve actuating mandrel and rotatably attached to said power piston so that said ratchet sleeve can rotate about a longitudinal axis of said housing relative to said power piston, said ratchet sleeve having a lug extending radially inward therefrom into operative engagement with a ratchet slot disposed in an outer surface of said valve actuating mandrel, said ratchet slot including a plurality of normal positions wherein an increase in well annulus pressure will cause said power piston and said actuating mandrel to move downward opening said flow tester valve means and a subsequent decrease in well annulus pressure will cause said power piston and said actuating mandrel to move upward closing said flow tester valve means.

8. The apparatus of claim 7, wherein:

said ratchet slot includes at least one open position wherein said flow tester valve means is maintained in its open position regardless of the level of pressure maintained in said well annulus, so that said apparatus may be run into or pulled out of a well with said flow tester valve means in its open position.

9. The apparatus of claim 8, wherein:

said ratchet slot includes at least one closed position wherein said flow tester valve means is maintained in its closed position regardless of the level of pressure in said well annulus so that pressure in said well annulus may be increased without opening said flow tester valve means.

10. The apparatus of claim 9, wherein:

said ratchet slot includes at least three sequential normal positions, followed by at least two sequential open positions.

11. The apparatus of claim 7, wherein:

said ratchet slot includes at least one closed position wherein said flow tester valve means is maintained in its closed position regardless of the level of pressure in said well annulus so that pressure in said well annulus may be increased without opening said valve means.

12. The apparatus of claim 1, wherein:

said ratchet means is further characterized as a means for allowing said well annulus to be pressure tested without opening said flow tester valve means.

13. The apparatus of claim 1, wherein:

said ratchet means is further characterized as a means for selectively maintaining said flow tester valve means in its open position regardless of the pressure level present in said well annulus.

14. The apparatus of claim 13, wherein:

said ratchet means is further characterized as a means for selectively maintaining said flow tester valve means in its open position during a reduction of pressure in said well annulus, regardless of how quickly well annulus pressure is reduced.

15. The apparatus of claim 1, wherein:

said ratchet means is further characterized as a means for selectively maintaining said flow tester valve means in its closed position when well annulus pressure exceeds hydrostatic pressure in a manner sufficient to move said power piston.

16. The apparatus of claim 1, wherein:

said ratchet means is further characterized as a means for allowing said apparatus to be run into and pulled out of a well with said flow tester valve means in its open position.

* * * * *